US006053718A

United States Patent [19]

Schmidt et al.

[11] Patent Number: 6,053,718

[45] Date of Patent: Apr. 25, 2000

[54] GEARED PUMP FOR CONVEYING FLUIDS

[75] Inventors: Eugen Schmidt, Merbelsrod; Herbert Schmidt, Lichtenau; Walter Thiele, Bonn, all of Germany

[73] Assignees: Geraete und Pumpenbau GmbH, Merbelsrod; SGL Carbon AG, Wiesbaden, both of Germany

[21] Appl. No.: 09/042,788

[22] Filed: Mar. 17, 1998

[30] Foreign Application Priority Data

Mar. 17, 1997 [DE] Germany ..... 197 10 804

[51] Int. Cl.[7] ..... F01C 21/00

[52] U.S. Cl. ..... 418/152; 418/171; 418/179

[58] Field of Search ..... 418/171, 179, 418/152

[56] References Cited

U.S. PATENT DOCUMENTS

| | | | |
|---|---|---|---|
| 2,611,323 | 9/1952 | Digney . | |
| 2,619,040 | 11/1952 | Maisch . | |
| 3,545,900 | 12/1970 | Viner et al. . | |
| 4,384,828 | 5/1983 | Rembold et al. | 418/152 X |
| 4,492,540 | 1/1985 | Yamamoto | 418/152 X |
| 4,583,924 | 4/1986 | Zenglein et al. . | |
| 4,615,663 | 10/1986 | Iio et al. | 418/152 |
| 4,804,317 | 2/1989 | Smart et al. | 418/152 X |
| 5,156,540 | 10/1992 | Fernau et al. . | |
| 5,181,844 | 1/1993 | Bishop et al. | 418/152 |

FOREIGN PATENT DOCUMENTS

| | | |
|---|---|---|
| 24 22 783 | 11/1975 | Germany . |
| 3340748A1 | 5/1985 | Germany . |
| 4021500A1 | 1/1992 | Germany . |

OTHER PUBLICATIONS

Japanese Patent Abstract No. 57148084 (Shuichi), dated Sep. 13, 1982.

"Kohlenstoff im Maschinenbau", Lothar Jörres, Aachen, Ingenieurwerkstoffe, 1989, No. 11/12, pp. 56–58.

"Kohlenstoff im Maschinenbau", Lothar Jörres, Aachen, Ingenieurwerkstoffe, 1990 No. 1/2, pp. 68–70.

*Primary Examiner*—Hoang Nguyen

*Attorney, Agent, or Firm*—Herbert L. Lerner; Laurence A. Greenberg; Werner H. Stemer

[57] ABSTRACT

An internally or externally geared pump for conveying fluids lacking or only having insufficient lubricating ability, includes gearwheels moving in an operating chamber of the pump, conveying fluids and being mounted completely in parts formed of a carbon material. Supports are formed from accurately worked lateral walls and a jacket of the operating chamber formed of the carbon material. The jacket surrounds the gearwheels in the radial direction and is likewise constructed as a support. Chambers on the suction side and on the pressure side for fluid supply and fluid removal, which are necessary for the operation of the pump, are molded into side walls of the operating chamber which is formed of carbon.

20 Claims, 4 Drawing Sheets

Fig. 1
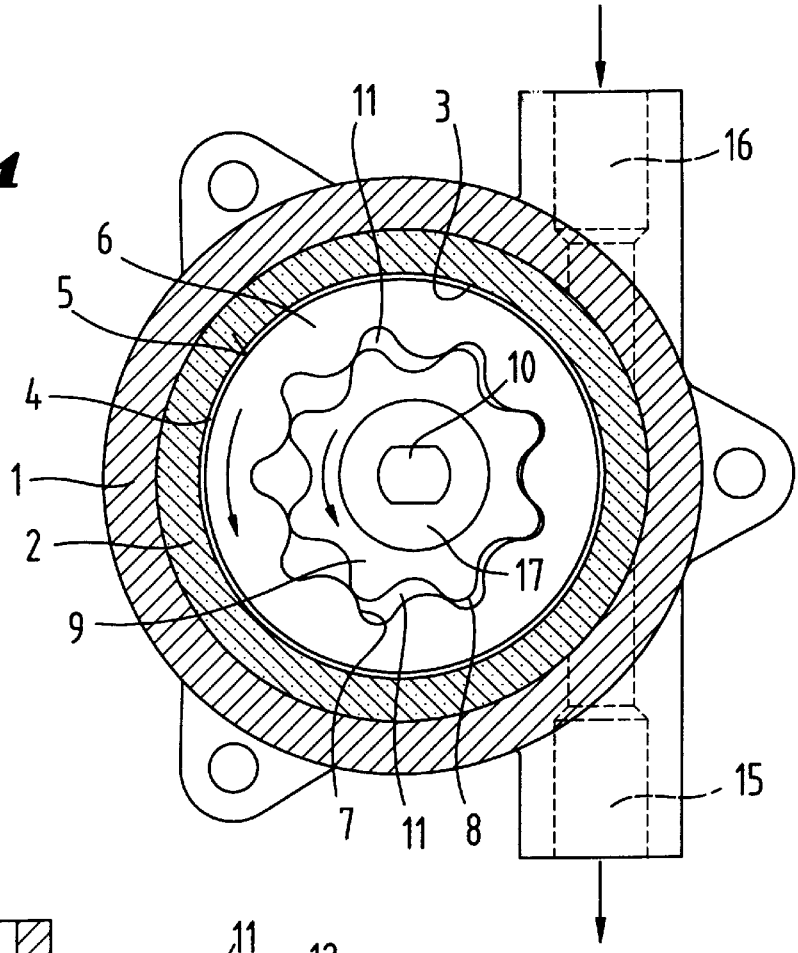
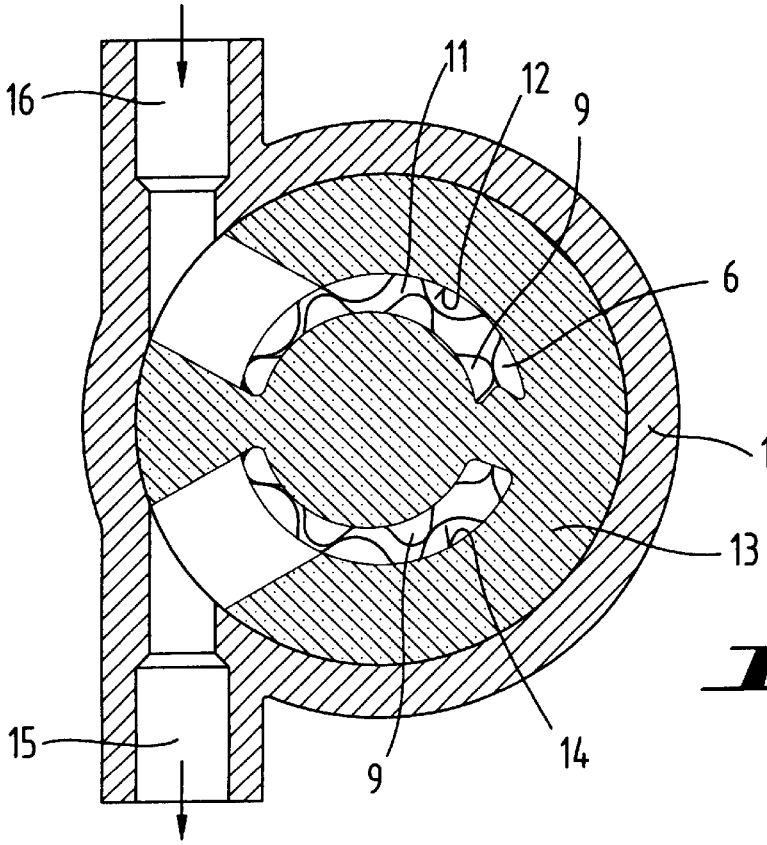
Fig. 2

Fig. 4
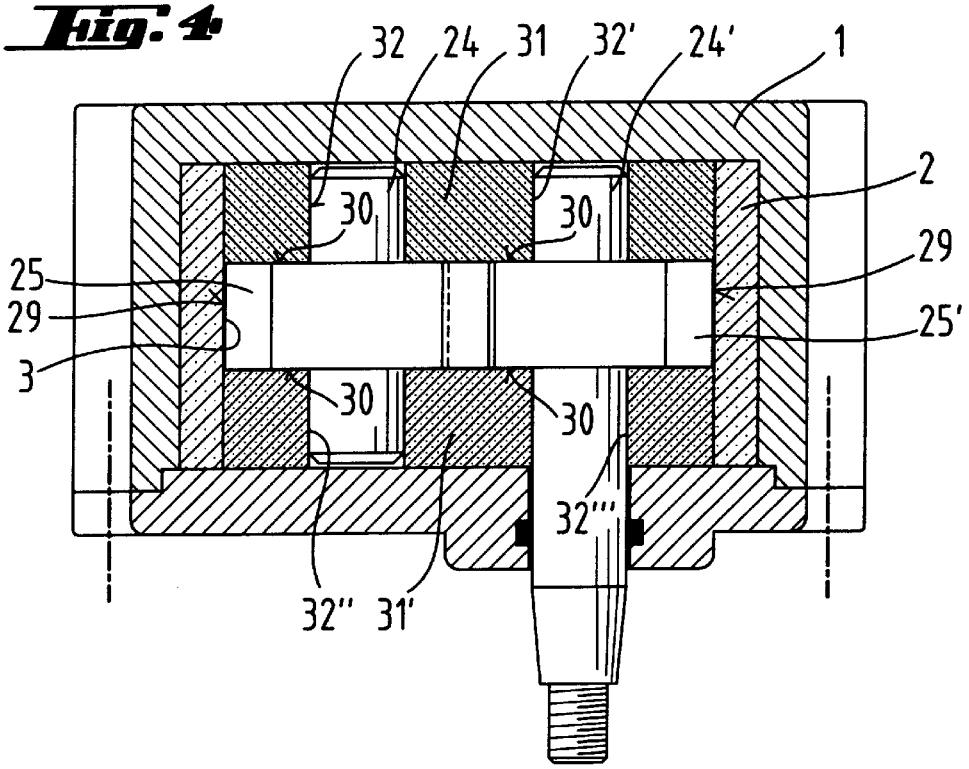
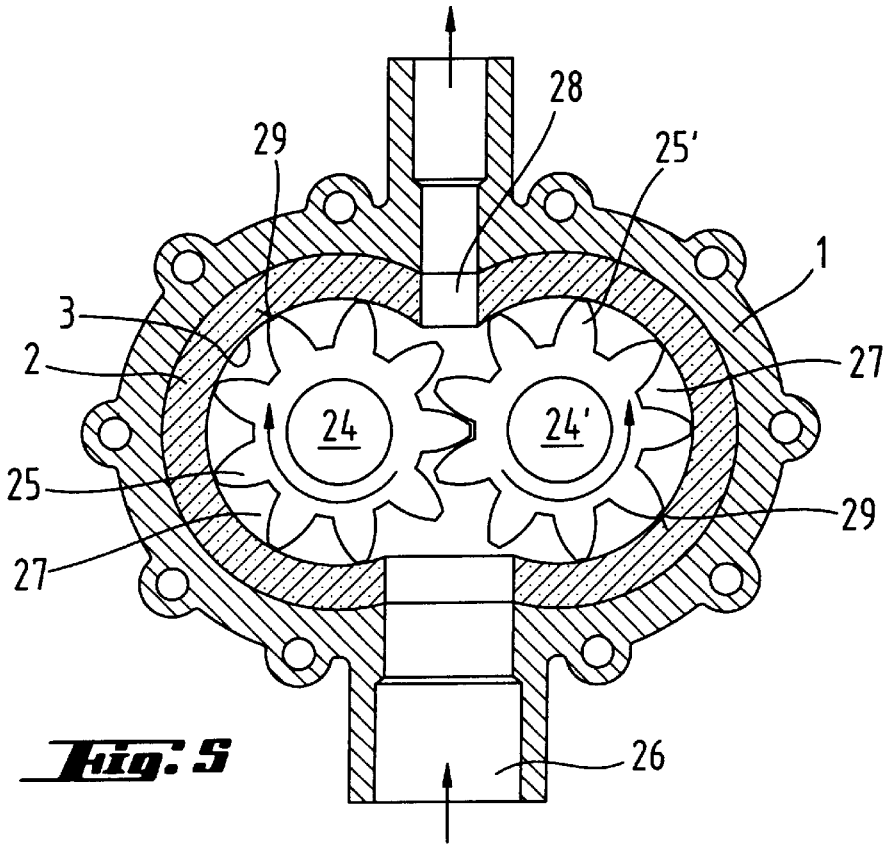
Fig. 5

GEARED PUMP FOR CONVEYING FLUIDS

BACKGROUND OF THE INVENTION

1. Field of the Invention

The invention relates to a geared pump for conveying fluids lacking or having insufficient lubricating ability, the pump including at least one connection for suction of the fluids and at least one connection for expulsion of the fluids, ducts and interstices joining the connection for the suction of the fluids and the connection for the expulsion of the fluids, and a conveying device for the fluids that is disposed in one of the interstices and includes an operating chamber in which two gearwheels rotate, the gearwheels mesh with each other while generating conveying spaces and reducing the conveying spaces again down to a minimum value, at least one duct on the suction side opens into the suction side of the operating chamber and at least one duct expels the fluids issuing from the pressure side of the operating chamber, and the meshing gearwheels are formed of a material from the group consisting of nonferrous metal, steel, special steel, industrial ceramics, metals and metal alloys produced by powder metallurgy, thermosetting and thermoplastic synthetic materials, thermosetting and thermoplastic synthetic materials containing fillers and synthetically produced carbon.

Geared pumps with an internal gear tooth system and those with an external gear tooth system are used in technology to a considerable extent for hydraulic power transmission in the pressure range of about 10 to 250 bar. They are used in the pressure range of about 2 to 10 bar for pure conveying tasks for the conveying of lubricating fluids such as oils of all kinds or of diesel fuel. When conveying fluids which lubricate badly or not at all, for example water, low-boiling hydrocarbons, in particular gasoline or kerosene, or liquids formed of solutions or mixtures, with the use of geared pumps, problems occur even after a short time at low output-side fluid pressures of about 2 to 10 bar. The friction becomes too high and the pumps fail due to erosion and/or corrosion. Problems of that kind also lead to the failure of the pumps in operating fields where temporary dry operation or periodically interrupted lubricating films have to be used.

SUMMARY OF THE INVENTION

It is accordingly an object of the invention to provide a geared pump, which overcomes the hereinafore-mentioned disadvantages of the heretofore-known devices of this general type, and which is suitable for conveying fluids that lubricate badly or not at all or run in a trouble-free manner under conditions in which dry operation occurs temporarily or a lubricating film periodically breaks down.

With the foregoing and other objects in view there is provided, in accordance with the invention, a geared pump for conveying fluids lacking or having insufficient lubricating ability, the pump comprising at least one connection for suction of fluids and at least one connection for expulsion of the fluids; ducts and interstices joining the connection for the suction of the fluids and the connection for the expulsion of the fluids; and a fluid conveying device disposed in one of the interstices and including an operating chamber having suction and expulsion sides, two gearwheels rotating in the operating chamber and mutually meshing for generating conveying spaces and reducing the conveying spaces again to a minimum value, and a housing of the operating chamber surrounding the gearwheels; at least one of the ducts for the suction of the fluids opening into the suction side of the operating chamber, and at least one of the ducts for the expulsion of the fluids opening from the pressure side of the operating chamber; the mutually meshing gearwheels formed of a material from the group consisting of nonferrous metal, steel, special steel, industrial ceramics, metals and metal alloys produced by powder metallurgy, thermosetting and thermoplastic synthetic materials, thermosetting and thermoplastic synthetic materials containing fillers and synthetically produced carbon; and the housing of the operating chamber formed of a synthetically produced material with a matrix formed of a carbonized, non-graphitized carbon and a filler bonded into the matrix, the filler formed of 35 to 97% by weight graphite, 0 to 62% by weight non-graphitized petroleum pitch coke or coal-tar pitch coke and 3 to 20% by weight mineral constituents.

Parts formed of carbon have been used for a long time in mechanical engineering, for example as sliding rings, sealing rings, sliding supports, gliding rings or shut-off valves (see, for example, articles by L. Jörres, in the publication entitled "Ingenieur-Werkstoffe 1" [Engineering Materials 1] No. 11/12 (1989) and "Ingenieur-Werkstoffe 2" [Engineering Materials 2], No. 1/2 (1990)). It is noted that if particular reference is not made to corresponding differences in material qualities, graphite is also to be included in the term carbon when used below. However, the use of such parts formed of carbon is not without problems because the use of carbon parts always depends on the selection of a material pairing which is suitable for the prevailing operating conditions. Parts formed of carbon which have proven to be good when operating with a certain countercurrent material in a certain operating medium can prove to be unsuitable when operating with another countercurrent material or in another operating medium. It is therefore extremely important to find suitable carbon qualities for the respective applications and there is no general technical rule for achieving that object. The mutual suitability of sliding or supporting materials that are paired with each other also depends on the machines and their structural conditions in which and with which the materials must run against each other. Therefore, for example, sliding ring seals are known in which one or both sealing rings is formed of a carbon material (German Utility Model G 94 19 961.2), or shut-off valves in dry-running rotation compressors or in wet-running wing cell pumps are also used if liquids with lubricating properties which are not very distinctive have to be conveyed. At first sight, such prior art could allow the conclusion to be drawn that the use of carbon parts in geared pumps, for which protection is requested in the instant patent application, is obvious to the expert. However, that is not the case. Despite the presence of a need therefor, up to the time of the invention there were no geared pumps which were suitable for conveying fluids with no or insufficient lubricating ability because, heretofore, appropriate attempts to convey such media with geared pumps had failed due to early failure of the pumps caused by erosion and/or corrosion. Many experts are even of the opinion that the conveying of fluids of the aforementioned type with geared pumps cannot be controlled technically. It is therefore a result of inventive activity if geared pumps are provided which are suitable for conveying such fluids that lubricate badly or not at all, in continuous operation.

An essential feature of the pumps is that the housing of the operating chamber of the pump, which housing surrounds the conveying gearwheels, is formed of a synthetically produced carbon material which is fluid-tight. In such a pump both gearwheels located in the conveying chamber are mounted axially in a sliding manner on the walls of the conveying chamber which surround them on both sides and which is formed of the carbon material. In the case of an externally geared pump the two sides of the operating chamber are additionally constructed as supporting blocks for the axles of the gearwheels, so that the axles of the gearwheels are also mounted in fittingly shaped supporting bushes of carbon. Furthermore, in the case of an internally geared pump the external gearwheel having the internal gear tooth system is additionally mounted in a sliding manner along its entire periphery in the radial direction on the inner jacket of the conveying or operating chamber, which inner jacket likewise is formed of the carbon material, and in the case of an externally geared pump the radially external tooth surfaces slide in a sealing manner along the inner jacket of the conveying chamber.

In contrast with the heretofore-existing applications of machine elements being formed of carbon materials in the field of dynamic seals and sliding elements, where the parts being formed of the carbon materials always only had one stress direction and one sliding surface, with the pumps in accordance with the invention several supporting configurations are united which in part differ substantially with respect to their loads and the demands made of their sliding properties. Within the meaning of the invention, a single material pairing must correspond to this particular combination of demands. In addition, during the operation of the pumps in accordance with the invention, operational states can also occur where the fluid film between the elements which slide against each other breaks down, for example when the pump starts or when the conveying current is chopped. The pumps in accordance with the invention are also suitable for conditions where a brief dry operation or operation with mixed friction is required.

The housing of the operating chamber is preferably formed of a carbon material with a matrix of a carbon which is carbonized but not heated to graphitization temperature. This matrix is obtained for the production of the carbon material by coking or carbonizing the bonding agent of an initial product body, wherein the bonding agent contains coking substances. The initial product body is formed of the binder and certain fillers. When this body is carbonized, work must be carried out below a temperature where graphitization processes begin. A final temperature of 900 to 1000° C. is preferably used. The coking or carbonizing is carried out in the manner known to the expert in the field of carbon technology with the exclusion of substances which have an oxidizing effect. The bonding agent used is either a coal-tar pitch, a petroleum pitch or a mixture of one of the aforementioned pitch types and a synthetic resin. When selecting the bonding agent it must be observed that after the carbonizing the bonding agent has a coke yield of at least 50%, preferably of more than 60% and in particular preferably of more than 65% by weight (determination according to DIN 51905). The binder is mixed with the filler in the manufacture of the carbon material. In this respect, the binder can be mixed with the filler both in liquid form and in finely powdered form. Mixing in a finely powdered form is used particularly when pitches with high softening points are processed. However, it is also possible to mix the binder in liquid form with the filler at temperatures above its softening point. After the mixing, shaped carbon bodies can be pressed from mixtures produced according to both mixing methods. The preferred procedure in working with pitches is the introduction and mixing-in of the bonding agent in powdered form and the subsequent pressing of shaped bodies from the mixture of filler powder and binder powder which is obtained. If a mixing of a binder in liquid form with the filler has been selected, it is advantageous to grind the obtained mixture of binder and filler before pressing, to form shaped bodies into a fine granulation and then to press this ground material to form shaped bodies. The pressing preferably takes place in die presses or isostatic presses. All of the so-called green shaped bodies produced according to one of the aforementioned methods are then supplied to the carbonizing process.

The filler content in the initial product and in the carbon material is formed of 35 to 97% by weight graphite, 0 to 62% by weight non-graphitized petroleum pitch coke or coal-tar pitch coke and 3 to 20% by weight mineral constituents which influence the tribological properties of the material.

In accordance with another feature of the invention, the graphitic part of the filler can be natural graphite, Kish graphite, electrographite, i.e. graphite produced by a synthetic, electrothermal method, or even graphitized coke, or it can be formed of a mixture of one or more of the aforementioned substances. In the electrothermal production of graphite, the material must be exposed to a temperature of at least 1800° C., preferably of more than 2400° C. up to 3000° C. during the graphitization process, which must likewise be carried out with the exclusion of media having an oxidizing effect.

The second part of the filler is formed of non-graphitized petroleum pitch coke or coal-tar pitch coke. These cokes already belong to the relatively hard part of the carbon material which has less lubricating ability, but which increases the capacity for resistance to abrasion.

In accordance with a further feature of the invention, the third-part of the filler is formed by hard materials which preferably are formed of or contain oxides, carbides, nitrides, borides or silicates.

In accordance with an added feature of the invention, silicon dioxide, silicon carbide, aluminum oxide, boron carbide, silicon nitride or feldspar are particularly preferred. These substances have the task of further increasing the resistance of the carbon material to abrasion and, during operation, of keeping the counter-running surfaces clean through the use of a light abrasive action.

Before being brought together with the bonding agent, each of the constituents which later form the filler is ground to the fineness of flour. The ground material produced in this respect preferably has sieving values which lie in the region of the combination of $d_{50}$=15 $\mu$m and $d_{95}$=55 $\mu$m. Grains with a size greater than 400 $\mu$m are sieved out.

After firing, the shaped bodies which are produced are still porous because of the loss of pyrolysis products of the binder content. They must also be made fluid-tight for use as structural material in pumps.

In accordance with an additional feature of the invention, this takes place by filling the pore system of the bodies to which liquid has access with a liquid impregnating medium that either solidifies or is hardened after the impregnation.

Thermosetting and thermoplastic synthetic resins are used as the least expensive impregnating medium which is also preferred in this case.

In accordance with yet another feature of the invention, resins from the group formed of phenolic resins, in particular of the resol type, furan resins or polyester resins, perfluorinated hydrocarbon resins or polyamide resins are particularly preferred in this case. When using synthetic resins as impregnating media it must be observed that the usage temperature of the pump is limited by the actual thermal loading capacity of the impregnating medium. Carbon parts for pumps which are to be operated at very high temperatures are impregnated with liquid metals or their alloys, for example copper and copper alloys or antimony and antimony alloys. In order to provide for the greatest demands, the carbon parts can also be made fluid-tight by a so-called Chemical Vapor Impregnation (CVI) that is known to the expert. In this process, gaseous substances are introduced at high temperatures into the pore system of the carbon parts. Those substances form carbon or other hard materials upon thermal decomposition. Along with this thermal decomposition, at least the pore openings are completely filled with carbon or with one of the hard materials, which effects a sealing of the body.

The gearwheels which mesh with each other in the conveying chamber or the operating area of the pump can be formed of different materials according to the structure, mechanical or thermal loading or the medium to be conveyed. In order to convey water, special steel or a nonferrous metal is preferably used, with the parts preferably having been made by a powder-metallurgical method. However, parts made from complete metal pieces or complete pieces of a metal alloy can also be usedp although their production is more costly and, in practice, they no longer have any pores. The parts can be formed of thermosetting or thermoplastic synthetic materials, for example hardened phenolic resins, furan resins, or polyester resins, or polyamides or polyimides, in the case of demands which are not too high with respect to the resistance to corrosion in the region of comparatively low temperatures. In order to improve the mechanical and thermal properties, these thermosetting resins and thermoplastic materials are frequently used, to advantage, in forms equipped with powdery and/or fibrous fillers. When selecting the fillers the expert refers to known specialist knowledge. Gearwheels made of industrial ceramics, for example porcelain or silicon carbide or, in particular, made of synthetically produced carbon grades suitable for use as sliding ring material or supporting material, are used for applications at higher temperatures and/or under operating conditions where there is more corrosion. In order to improve their tribological properties, the carbon bodies can be provided with an impregnation or coating of a hard material, for example SiC, TiC, WC, $TiB_2$, $Si_3N_4$ or BC according to one of the methods known from the prior art, for example CVI, CVD (Chemical Vapor Deposition) or CVR (Chemical Vapor Reaction). The expert selects the material which is suitable according to the given technical limiting conditions with the aid of tests that can be carried out easily.

If the pump housing which is formed of the carbon material and which limits the operating chamber of the pump, has a correspondingly stable, i.e. thick-walled construction, an additional cover supporting and protecting this housing is not necessary. However, the housing formed of the carbon material is usually surrounded by a cover which supports it mechanically, absorbs internal pressures and protects it against mechanical damage such as knocks or impacts. This cover can be formed of a metallic material, a synthetic material or a material reinforced with fibers. It is constructed in accordance with known technological regulations.

In accordance with yet a further feature of the invention, one of the preferred types of structure of the pumps in accordance with the invention is that of internally geared pumps where two gearwheels are disposed one inside the other in the operating chamber of the pump, the internal gearwheel is driven, and the gearwheels rotate in such a way that when the external gear tooth system of the internal gearwheel meshes with the teeth located on the inside of the external, annular gearwheel, on the suction side of the pump, new conveying areas are constantly created, into which the fluids to be conveyed penetrate, and on the pressure side of the pump these conveying areas are continuously reduced again down to a minimum value, resulting in the fluids located in the conveying areas being expelled into the pressure duct. A condition for the operability of such a pump is that the internal gearwheel has a smaller number of teeth than the external gearwheel.

In accordance with yet an added feature of the invention, the housing of the operating chamber of the pump is formed of two parts which are connected to each other in a fluid-tight manner. The first part has the form of a cup with a base and a cylindrical jacket-shaped wall. The second part covers the interior of the first part completely, having a fluid-tight connection with the upper part of the cylindrical jacket-shaped wall of the first part. The second part preferably lies on the upper, free edge of the wall of the first part in a fluid-tight manner. Upon operation of the pump as usual, one must imagine that the cup provided with the cover lies on its wall surface. The gearwheels of the conveying device are mounted within the chamber which is formed by the cup and the cover, with all of the walls of the carbon material which limit the chamber on the inside simultaneously representing the supports. In the process, the following different supporting configurations result. On one hand, the surface area of the external gearwheel which is on the outside when seen in the radial direction is mounted on the inner wall of the cylindrical jacket-shaped wall of the cup and is rolled away there when the pump is operated, and on the other hand both sides of the two gearwheels are mounted in a sliding and sealing manner at the side walls of the operating chamber, that is to say on one hand on the base of the cup and on the other hand at the inside of the cover. The suction-side and pressure-side recesses in the side walls of the operating chamber, which recesses are necessary for the operation of the pump and are coordinated with the conveying areas in the gearwheels of the pump and are connected to the corresponding suction and pressure ducts, can be disposed in one of the two lateral parts which limit the operating chamber (base of the cup or cover). The lateral part in which these recesses with their duct connections are located then has to be constructed to be so thick that there is room therein for these functional elements of the pump. These recesses are preferably accommodated in the lateral part of the operating area which is directed away from the driving mechanism of the pump. However, it is also possible to place these functional elements on the driving mechanism side or to place the recesses on both sides of the operating chamber.

In accordance with yet an additional feature of the invention, the operating chamber housing is formed of carbon and is formed of three parts, namely a part which completely surrounds the operating chamber in the radial direction and which is hollow-cylindrical on its inside, and two plates or blocks which completely cover two open sides of this part that is hollow-cylindrical on the inside, the plates or blocks forming a seal with the ends of these two sides in a fluid-tight manner. The supporting configuration of the gearwheels and the driving mechanism of the internal gearwheel corresponds to that of a pump with a two-part housing, with the difference being that the support disposed in the base of the cup in the two-part structure is now replaced by the support in a block-shaped or plate-shaped side wall. The method by which the pump or the supporting configuration of the gearwheels functions is not changed thereby. As far as the configuration of the suction-side and the pressure-side recesses and the fluid ducts connected to them are concerned, the structural features described with regard to the previously described two-part form of the housing of the operating chamber are also possible in this case. In addition, with the three-part embodiment, parts of the suction-side and the pressure-side ducts can also be disposed in the wall of the part which is hollow-cylindrical on the inside.

In accordance with again another feature of the invention, the inner gearwheel of the internally geared pump preferably has a shaft disposed centrally on one of its flat sides, the shaft is sealed on this side, is led through the housing of the operating chamber to the outside and is connected there to a driving mechanism. However, for reasons of quiet running it can be necessary to equip the inner gearwheel with shafts issuing from both flat sides, wherein one shaft of which is led in a sealed manner through the housing of the operating chamber and is connected to a driving mechanism, and the other shaft is mounted in the other side wall of the housing of the operating chamber.

In accordance with again a further feature of the invention, in order to provide an improved control of the gearwheels of an internally geared pump, one or both of the flat sides of the driven gearwheel has a cylindrical projection thereon disposed concentrically about the shaft of the gearwheel and firmly connected to the gearwheel, and the projection fits into a complementary hollow-cylindrical recess in the adjacent inner wall surface of the operating chamber and is rotatably mounted there with little tolerance. If the shaft only extends to one side of the gearwheel, then such cylindrical projections with their complementary supports can nevertheless be located on the two sides of the gearwheel in the adjacent side wall of the operating chamber. The cylindrical projection can also be constructed in the form of a cylindrical jacket disposed concentrically about the shaft, wherein the radially outer surface area of the cylinder jacket is the running surface which slides in the support. For reasons of cost, the structure is preferably used with an additional supporting configuration which is only disposed on one of the flat sides.

In accordance with again an added feature of the invention, the geared pump is an externally geared pump, two gearwheels are each provided with a respective external gear tooth system and are disposed next to each other in an operating chamber, and the teeth of these gearwheels mesh with each other in sealing the suction chamber from the pressure chamber of the pump, with the fluid which is in the intermediate teeth areas of the teeth that are not meshed with each other being conveyed from the suction side to the pressure side and being expelled on the pressure side by the pressure which is built up by the conveying.

Additionally, according to the invention, with this type of pump, at least the walls of the operating chamber are formed of a carbon material, and the gearwheels bear at several locations on and in the walls which limit the operating chamber. Firstly, the sides of the gearwheels disposed in the axial direction slide in a sealing manner on the side walls of the operating chamber. Secondly, the external radial sides of the teeth of the gearwheels slide along their entire width in a sealing manner on the internal wall of the cover part which limits the operating area in the radial direction, and thirdly, the shafts of the gearwheels are mounted in supporting blocks of carbon which are located in the lateral parts of carbon material that form the lateral walls of the operating chamber.

In accordance with a concomitant feature of the invention, the housing of the operating chamber of an externally geared pump of this kind is preferably formed of three parts. Firstly, it includes two supporting blocks which contain the supports for the shafts of the gearwheels and which at the same time are used as lateral limiters of the operating chamber of the pump on both sides which are disposed in the axial direction with respect to the gearwheels. Secondly, it includes a jacket-shaped cover part which is connected to the two lateral blocks or plates in a fluid-tight manner, is compact in itself and on its inside follows the radial outer contour of the gearwheels, contains the suction chamber and the pressure chamber and is provided with openings for the fluid inlet and the fluid outlet.

The pumps according to the invention are preferably used to convey liquids of the previously mentioned type with pressures on the pressure side of 2 bar and more, and with 3 to 8 bar being preferred in particular.

The production of a carbon material for a housing of the operating chamber of internally geared pumps is described by way of example in the following: 78% by weight of a macrocrystalline natural graphite which can be purchased, 14% by weight of a graphitized coal-tar pitch coke and 8% by weight of a mixture of 60 parts by weight of quartz powder and 40 parts by weight of feldspar, all of which had been ground to a grain fineness of $d_{50}$=15 $\mu$m, $d_{95}$=55 $\mu$m and with which a grain content of more than 350 $\mu$m had been sieved out, were mixed intensively in a dry state. Then 30 parts by weight of a finely powdered coal-tar pitch were added to 70 parts by weight of this mixture, wherein the coal-tar pitch had a softening point according to DIN 51920 of 110° C. and a coke residue according to DIN 51905 of 62%. After that, fillers and pitch binders were homogenously mixed at room temperature in a rapid mixer. After discharge from the mixer, the finely powdered mixture was poured into the compression mold of a die press and pressed there without external heating under a pressure of 200 MPa to form a shaped body. If the somewhat difficult handling with the finely powdered mixture is to be avoided, heating to a product temperature of about 150° C. with further mixing can also take place after the thorough mixing of the powdery filler with the powdery binder. After the discharge from the mixer and the cooling of the mixture it must then be broken up or ground to a fineness with a maximum grain size of 1 mm. The bulk ground material which is obtained in this way and which can be handled more easily is then pressed to form shaped bodies, as was previously described. The shaped bodies were then heated in an annular furnace with a burning regime for fine-grained carbon material up to a final temperature of 1200° C., with the binder being carbonized and a porous, firm carbon body being obtained. This body was then impregnated with an impregnating resin of the phenol resol type in accordance with the vacuum pressure method, in order to produce fluid-tightness. The parts that are necessary for the housing of a geared pump were then produced by machining from the impregnated blank being formed of the carbon material. The fluid-tight carbon material had the following physical data:

| | |
|---|---|
| hardness HRB 10/100 (DIN 51917) | 100 |
| bulk density (DIN IEC 413) | 1.83 g/cm$^3$ |
| bending strength (DIN 51902) | 55 MPa |
| E-modulus (DIN 51915) | 20 GPa |

An internally geared pump in accordance with the invention, having gearwheels which were formed of powder-metallurgically produced special steel (Material No. Sint C 40, DIN 30910), in which the walls of the operating chamber were formed of a carbon material, and the production of which has been described in Example 1, was operated in continuous operation without any trouble with water as the medium to be conveyed at a speed of 3000/min and a conveying capacity of 6 l/min for 30 days. After this extended time test none of the parts located in the operating chamber showed any appearances of erosion or corrosion. The sliding and supporting surfaces were in an excellent state.

Other features which are considered as characteristic for the invention are set forth in the appended claims. Although the invention is illustrated and described herein as embodied in a geared pump for conveying fluids, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagrammatic, cross-sectional view through an operating chamber of an internally geared pump;

FIG. 2 is a cross-sectional view through a block of a carbon material which contains one side wall of an operating chamber of an internally geared pump, which is taken along a line II—II of FIG. 3, in the direction of the arrows;

FIG. 4 is a cross-sectional view through an externally geared pump parallel to axles of gearwheels; and FIG. 5 is a cross-sectional view through an externally geared pump at right angles to axles of gearwheels.

DESCRIPTION OF THE PREFERRED EMBODIMENTS

Figure 3:
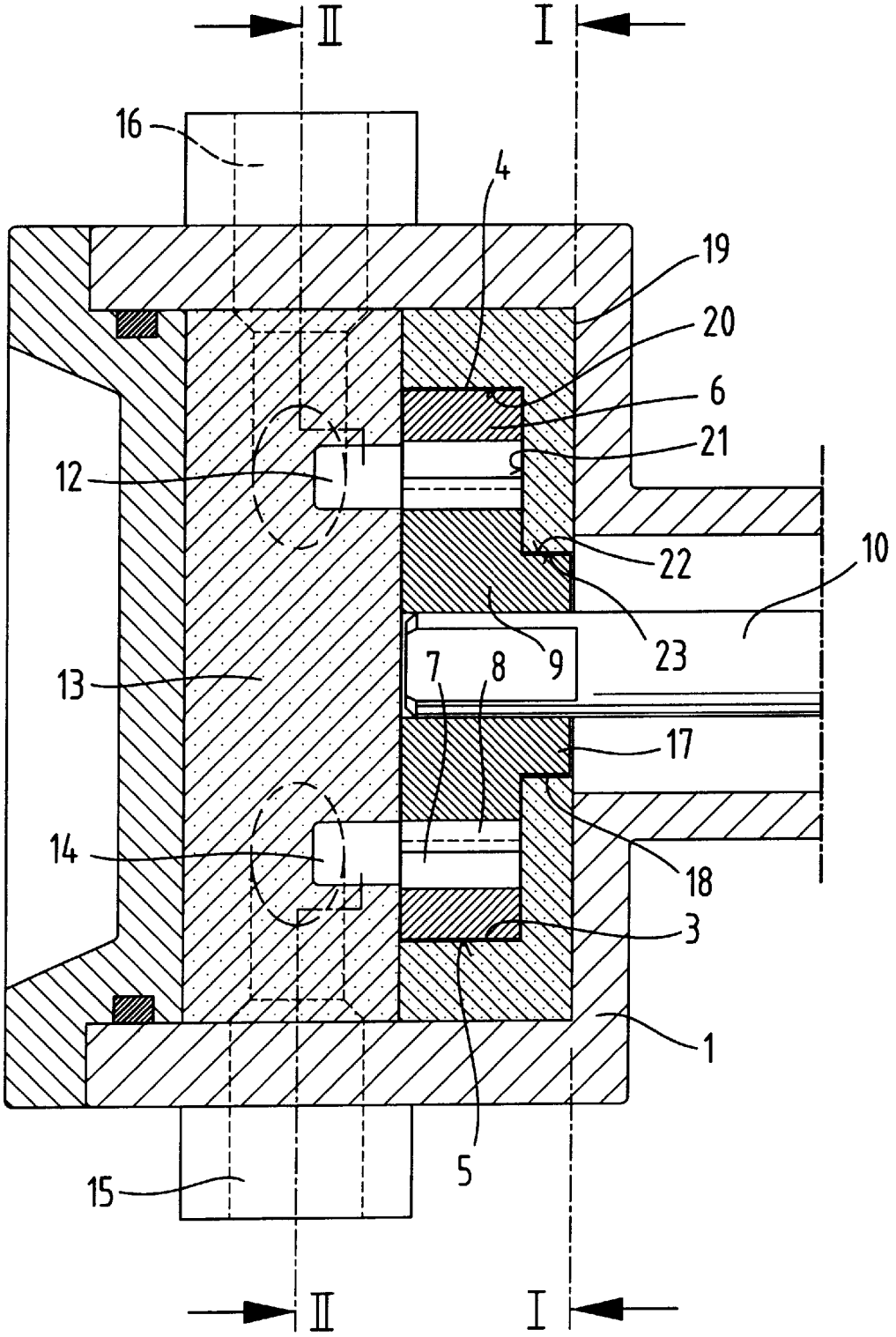
FIGS. 3, 3*a* and 3*b* are cross-sectional views through an operating chamber of an internally geared pump parallel to an axle of an internal gearwheel.

Referring now to the figures of the drawings in detail and first, particularly, to FIG. 1 thereof, there is seen a cross section through an internally geared pump. The pump has a suction connection indicated by an arrow pointing downward at the top and an expulsion connection indicated by an arrow pointing downward at the bottom. As seen from the outside to the inside, the pump includes a cast metal housing 1 that surrounds a jacket of a carbon housing 2 of an operating chamber 3 in a protective and supporting manner. The operating chamber 3 is then followed by a supporting zone 4, which is represented in this case as a gap that is too large, between the housing formed of the carbon material 2 and a radially outer running surface 5 of an external gearwheel 6. The external gearwheel 6 has an internal gear tooth system 7 which has one more tooth than an external gear tooth system 8 of an internal gearwheel 9 which runs therein. On one hand, the internal gearwheel 9 is driven by way of a shaft 10 which is disposed eccentrically in the pump housing. On the other hand, the external gearwheel 6 is disposed centrally in the operating chamber 3. Upon rotation, the teeth 8 of the internal gearwheel 9 engage depressions of the internal gear tooth system 7 of the external gearwheel 6 completely on one side, then they free interstices 11 to an increasing extent on a suction side of the pump because of a gear difference in the two gear tooth systems 7, 8 that engage with each other. Liquid to be conveyed can flow from recesses 12 shown in FIG. 2 into the interstices. The recesses are located on a suction side of the pump, are called "suction recesses" in this case, are disposed in a side wall 13 of the operating chamber 3 which can be seen in FIG. 3 and are connected to a suction duct 16 of the pump seen in FIG. 2. The teeth 8 of the internal gearwheel 9 close these interstices 11 on the subsequent pressure side of the pump, while the liquid located in the interstices is expelled into recesses 14 which are called "pressure recesses" in this case, are connected to a pressure duct 15 seen in FIG. 2 and are disposed on the pressure side of the pump. On the side of the shaft 10, the internal gearwheel 9 has a concentric cylindrical projection 17 which is mounted in an additional support 18 shown in FIG. 3. The support is used to increase the quiet running of the pump.

FIG. 2 shows a cross section through a block formed of a carbon material which forms one of the lateral walls of the operating chamber 3. The block is again surrounded by a housing 1 of cast metal, into which the suction duct 16 and the pressure duct 15 of the pump are also formed. The suction duct 16 is connected from the suction connection to the recess 12 which is the so-called "suction recess" in the side wall of the operating chamber 3 and the pressure duct 15 is connected from the expulsion connection to the recess 14 which is the so-called "pressure recess" in the side wall of the operating chamber 3. The method in which the pump functions can be followed easily in combination with the description given in FIG. 1. The gearwheels 6 and 9 rotating in the operating chamber 3 are mounted in a sliding manner on the surface of the block of carbon which forms the side wall and which is illustrated herein, and the outer gearwheel 6, as shown in FIG. 1, slides additionally with its outer running surface 5 on the internal wall of the jacket of the carbon housing 2 of the operating chamber 3 as an additional support.

FIG. 3 shows a cross section through the operating chamber 3 of an internally geared pump, parallel to the direction of the shaft 10 of the internal gearwheel 9. A first part of the housing is a carbon housing 19 which is cup-shaped in this case and which on one hand supports the radial support 4 for the external gearwheel 6 on the inside of its cylindrical jacket-shaped internal wall 20 and on which the two lateral surfaces of the gearwheels 6 and 9 on an internal surface of a base 21 are mounted, is also surrounded in this case by a housing 1 of cast metal. The internal gearwheel 9 has a cylindrical projection 17 disposed concentrically about its shaft 10, with a radial supporting surface 22 which is fitted into a complementary opposed supporting surface 23 located in the base of the cup-shaped part of the housing 19, and which runs in the housing. The side wall 13 of the operating chamber 3 is a second plate or blocked-shaped part of the housing which covers the first part 19.

Figure 3A:
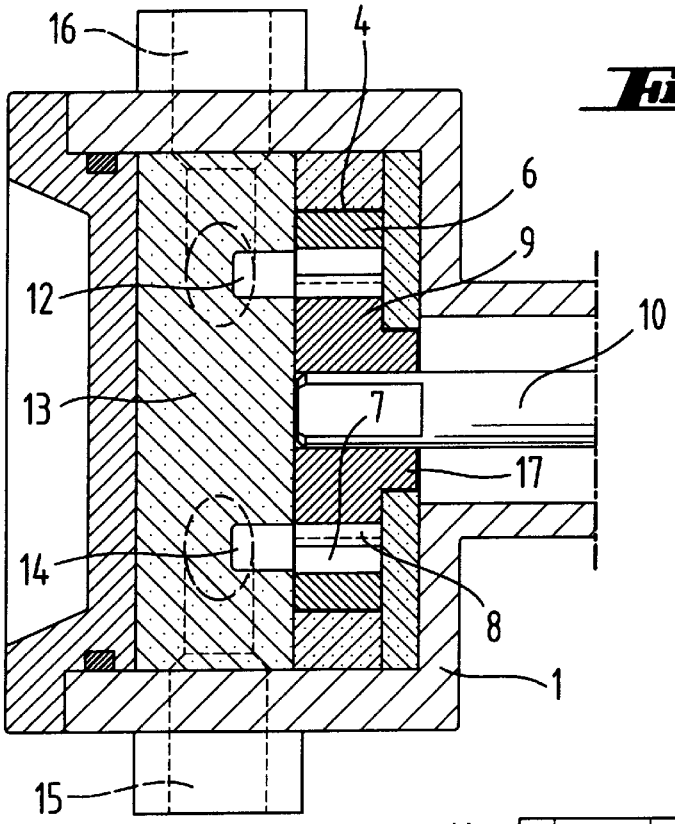

The embodiment of FIG. 3*a* differs from that of FIG. 3 in that the housing of the operating chamber 3 is formed of three parts, namely one part which completely surrounds the operating chamber 3 in the radial direction and which is hollow cylindrical on its inside and two plate or block-shaped parts which completely cover the two open sides of this part that is hollow cylindrical on the inside. The plates or blocks form a seal with the ends of these two open sides in a fluid tight manner.

Figure 3B:
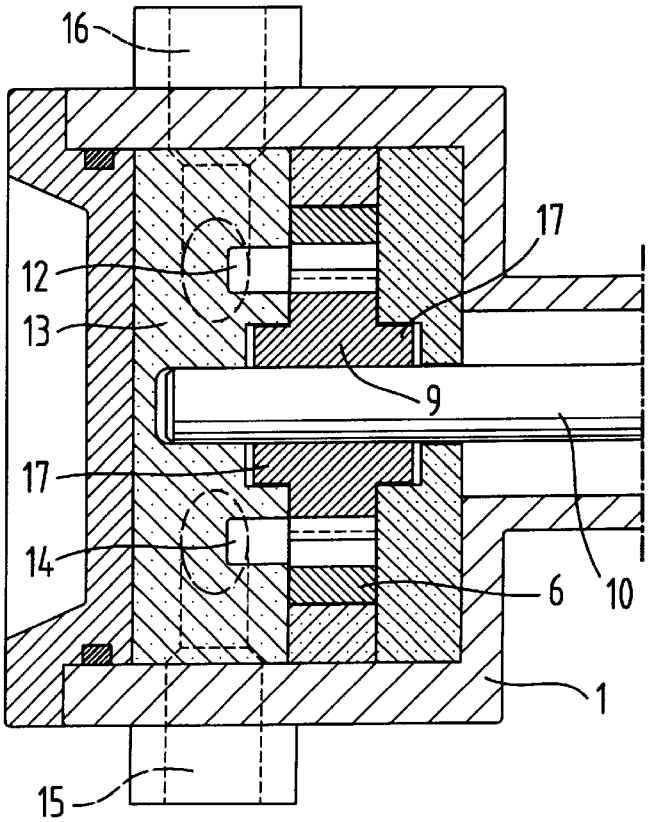

In the embodiment of FIG. 3*b*, the internal gearwheel 9 has two cylindrical projections 17 disposed concentrically about the shaft 10 which passes through them. These projections 17 fit into complementary hollow cylindrical recesses in the respective adjacent inner wall surface of the operating chamber and are rotatably mounted there with little tolerances. The shaft 10 protrudes from both flat sides of the inner gear wheel 9 and its bearings are disposed in recesses in the side walls of the housing of the operating chamber.

FIGS. 4 and 5 show two cross sections through an externally geared pump, wherein the one shown in FIG. 4 is parallel to shafts 24, 24' of gearwheels 25, 25' and the other shown in FIG. 5 is at right angles to the shafts 24, 24' of the gearwheels 25, 25'. As can be seen in FIG. 5, the liquid to be conveyed enters a suction chamber 26 of the pump driven by one of the shafts 24, 24' of the gearwheels 25, 25', is enclosed in intermediate teeth areas 27 of the gearwheels 25, 25' rotating in opposite directions, is conveyed into a pressure chamber 28 of the pump and from there is expelled from the pump. The suction chamber 26 and the pressure chamber 28 of the pump are separated from each other by the tightly meshing teeth of the gearwheels 25, 25'. In this case as well, the operating chamber 3 of the pump is surrounded by a housing of a carbon material 2 which abuts an outer periphery 29 and lateral surfaces 30 of the gearwheels 25, 25' in a sliding and sealing manner and forms various supports. The various carbon parts which form the walls of the operating chamber 3 and their function can be recognized clearly in FIG. 4. The side walls are formed by blocks 31 and 31' which at the same time contain supports 32, 32', 32", 32"' for the shafts 24, 24' of the gearwheels 25, 25'. The sides of the blocks 31, 31' facing the operating chamber 3 form sealing sliding supports for the lateral surfaces 30 of the gearwheels 25, 25'. In the circumferential direction the operating chamber 3 is completely enclosed by the carbon jacket 2 which abuts the outer periphery 29 of the gearwheels 25, 25' in a sealing and sliding manner along conveying zones formed by the intermediate teeth areas 27. This jacket also has openings for the suction duct 26 and the pressure duct 28 of the pump.

We claim:

1. A geared pump for conveying fluids lacking or having insufficient lubricating ability, the pump comprising:

at least one connection for suction of fluids and at least one connection for expulsion of the fluids;

ducts and interstices joining the connection for the suction of the fluids and the connection for the expulsion of the fluids; and a fluid conveying device disposed in one of said interstices and including an operating chamber having suction and expulsion sides, two gearwheels rotating in said operating chamber and mutually meshing for generating conveying spaces and reducing the conveying spaces again to a minimum value, and a housing of said operating chamber surrounding said gearwheels;

at least one of said ducts for the suction of the fluids opening into said suction side of said operating chamber, and at least one of said ducts for the expulsion of the fluids opening from said pressure side of said operating chamber;

said mutually meshing gearwheels formed of a material from the group consisting of nonferrous metal, steel, special steel, industrial ceramics, metals and metal alloys produced by powder metallurgy, thermosetting and thermoplastic synthetic materials, thermosetting and thermoplastic synthetic materials containing fillers and synthetically produced carbon; and said housing of said operating chamber formed of a synthetically produced material with a matrix formed of a carbonized, non-graphitized carbon and a filler bonded into the matrix, said filler formed of 35 to 97% by weight graphite, 0 to 62% by weight non-graphitized petroleum pitch coke or coal-tar pitch coke and 3 to 20% by weight mineral constituents.

2. The geared pump according to claim 1, wherein said graphite filler is a substance from the group consisting of natural graphite, Kish graphite, electrographite, graphitized coke and mixtures of said substances of said group.

3. The geared pump according to claim 1, wherein said mineral constituents are hard materials from the group consisting of oxides, carbides, nitrides, borides and silicates.

4. The geared pump according to claim 3, wherein said mineral constituents are substances from the group consisting of silicon dioxide, silicon carbide, aluminum oxide, boron carbide, silicon nitride and feldspar.

5. The geared pump according to claim 1, wherein said matrix formed of fired, non-graphitized carbon has originated from a binder from the group consisting of coal-tar pitch, petroleum pitch, mixtures of pitch and synthetic resin by coking, and said binder has a carbon yield according to DIN 51905 of at least 50%.

6. The geared pump according to claim 1, wherein said carbon of said housing of said operating chamber has pores filled with a hardened impregnating medium for producing fluid-tightness.

7. The geared pump according to claim 6, wherein said hardened impregnating medium is a hardened or solidified synthetic resin from the group consisting of phenolic resins, furan resins, polyester resins, polyamides and fluorinated hydrocarbons.

8. The geared pump according to claim 1, wherein said gearwheels in said operating chamber include an internal gearwheel to be rotated by a driving mechanism and an external gearwheel surrounding said internal gearwheel, said internal gearwheel having an external gear tooth system with teeth, and said external gearwheel having an internal gear tooth system with teeth meshing with said teeth of said external gear tooth system, to form an internally geared pump.

9. The geared pump according to claim 8, wherein:

said housing of said operating chamber has first and second parts;

said first part is approximately cup-shaped and has an open side, a cup base and a cylindrical jacket-shaped wall with an inner surface;

said second part is plate or block-shaped part, rests at said open side of said cup-shaped part and acts in a sealing manner like a cover on said first part;

said two gearwheels have flat sides, one of said flat sides of each of said two gearwheels is mounted on said cup base, the other of said flat sides of each of said two gearwheels is mounted on said second part, said external gearwheel has a periphery entirely mounted on said inner surface of said cylindrical jacket-shaped wall;

said operating chamber has recesses formed therein required for pump operation; and at least parts of said suction and said pressure ducts and said recesses are located in at least one of said first and second parts.

10. The geared pump according to claim 9, wherein said recesses required for the pump operation are located only in said second part, and said recesses are each connected to parts of said suction and pressure ducts necessary for the operation.

11. The geared pump according to claim 8, wherein:

said operating chamber has a periphery and recesses necessary for pump operation;

said housing of said operating chamber has first, second and third parts;

said first and second parts are plates or blocks limiting said operating chamber laterally, having inner surfaces and forming a lateral operating area limitation;

said third part has an inner wall surface and a cylindrical inner surface entirely surrounding said periphery of said operating chamber and sealingly connected to said two plates or blocks;

said two gearwheels have flat sides each mounted on and facing said inner surfaces of said plates or blocks, and said external gearwheel radially mounted on said inner wall surface of said third part; and at least parts of said suction and said pressure ducts and said recesses located in at least one of said first, second and third parts.

12. The geared pump according to claim 11, wherein said recesses required for the pump operation are only located in one of said plate-shaped or block-shaped parts limiting said operating chamber laterally, and said recesses are connected to parts of said suction and pressure ducts required for the operation.

13. The geared pump according to claim 9, wherein said internal gearwheel has two flat sides and a central shaft on one of said flat sides, said shaft is led through and sealed against one of said laterally disposed plate-shaped or block-shaped parts and is connected to a driving mechanism, and said internal gearwheel has a cylindrical or cylindrical jacket-shaped projection disposed on said one flat side, rotationally symmetrical about said shaft or at a distance from said shaft and mounted in a recess formed in said adjacent plate-shaped or block-shaped part and complementary to said projection.

14. The geared pump according to claim 13, wherein said cylindrical or cylindrical jacket-shaped projections of said internal gearwheel are disposed on both of said flat sides and mounted in recesses complementary to said projections, said recesses are respectively formed in adjacent plate-shaped or block-shaped parts, and said projection disposed on said other side without said shaft extending rotationally symmetrically about an imaginary shaft being an extension of said shaft present on said one side.

15. The geared pump according to claim 11, wherein said internal gearwheel has flat sides and a central shaft on one of said flat sides, said shaft is led through and sealed against one of said laterally disposed plate-shaped or block-shaped parts and is connected to a driving mechanism, and said internal gearwheel has a cylindrical or cylindrical jacket-shaped projection disposed on said one flat side, rotationally symmetrical about said shaft or at a distance from said shaft and mounted in a recess complementary to said projection and located in an adjacent plate-shaped or block-shaped part.

16. The geared pump according to claim 15, wherein said internal gearwheel has cylindrical or cylindrical jacket-shaped projections disposed on both of said flat sides and mounted in recesses complementary to said projections, said respective recesses disposed in said adjacent plate-shaped or block-shaped part, and said projection disposed on said other side without said shaft extending rotationally symmetrically about an imaginary shaft being an extension of said shaft present on said one side.

17. The geared pump according to claim 9, wherein said internal gearwheel has a central shaft extending towards both sides, said shaft is mounted in both of said plate-shaped or block-shaped parts adjacent said internal gearwheel, is led through and sealed on one side against one of said laterally disposed plate-shaped or block-shaped parts and is connected to a driving mechanism, said internal gearwheel has flat sides and a cylindrical or cylindrical jacket-shaped projection disposed on each of said flat sides and disposed rotationally symmetrically about said shaft or at a distance from said shaft, and said projection is mounted in said respectively adjoining, laterally disposed, plate-shaped or block-shaped part in a recess complementary to said respective cylindrical or cylindrical jacket-shaped projection.

18. The geared pump according to claim 11, wherein said internal gearwheel has a central shaft extending towards both sides, said shaft is mounted in both of said plate-shaped or block-shaped parts adjacent said internal gearwheel, is led through and sealed on one side against one of said laterally disposed plate-shaped or block-shaped parts and is connected to a driving mechanism, said internal gearwheel has flat sides and a cylindrical or cylindrical jacket-shaped projection disposed on each of said flat sides and disposed rotationally symmetrically about said shaft or at a distance from said shaft, and said projection is mounted in a respectively adjoining, laterally disposed, plate-shaped or block-shaped part in a recess complementary to the respective cylindrical or cylindrical jacket-shaped projection.

19. The geared pump according to claim 1, wherein said two gearwheels have external gears disposed next to each other in said operating chamber of said conveying device, said external gears mesh with each other and one of said external gears is driven, to form an externally geared pump.

20. The geared pump according to claim 19, wherein said gearwheels have shafts, said housing of said operating chamber is formed of three parts including two supporting blocks abutting said gearwheels in a laterally sliding manner, laterally limiting said operating chamber and having recesses for accommodating said shafts of said gearwheels, and a cover part completely limiting said operating chamber in radial direction relative to said gearwheels.

* * * * *